US006672974B1

(12) United States Patent
Tartagni et al.

(10) Patent No.: US 6,672,974 B1
(45) Date of Patent: Jan. 6, 2004

(54) PUTTING STROKE TRAINING AID

(75) Inventors: Joseph J. Tartagni, West Haven, CT (US); Paul Schmid, Milford, CT (US)

(73) Assignee: TST & Associates, LLC, West Haven, CT (US)

( * ) Notice: Subject to any disclaimer, the term of this patent is extended or adjusted under 35 U.S.C. 154(b) by 0 days.

(21) Appl. No.: 10/364,120

(22) Filed: Feb. 11, 2003

(51) Int. Cl.[7] ..... A63B 57/00
(52) U.S. Cl. ..... 473/229
(58) Field of Search ..... 473/258, 257, 473/259, 260, 261, 229, 266

(56) References Cited

U.S. PATENT DOCUMENTS

| | | | |
|---|---|---|---|
| 1,399,761 | A | 12/1921 | Garland |
| 1,634,103 | A | 6/1927 | Hansen |
| 2,084,902 | A | 6/1937 | Eisenberg |
| 2,723,858 | A | 11/1955 | Chizewski |
| 2,776,836 | A | 1/1957 | Zadina |
| 3,132,865 | A | 5/1964 | Parker |
| 3,339,927 | A | 9/1967 | Nunn |
| 3,471,155 | A | 10/1969 | Donaldson |
| 3,473,810 | A | 10/1969 | Nishikawa |
| 3,685,835 | A | 8/1972 | Fahy |
| 3,844,569 | A | 10/1974 | Swanson |
| 3,953,035 | A | 4/1976 | Beckisk |
| 4,133,535 | A | 1/1979 | Marsh |
| 4,535,992 | A | 8/1985 | Slagle |
| 4,634,131 | A | 1/1987 | Vella et al. |
| 4,700,949 | A | 10/1987 | Nottoli |
| 5,026,066 | A | 6/1991 | Kane |
| 5,074,565 | A | 12/1991 | Tucker |
| 5,586,945 | A | 12/1996 | Vonderhaar |
| 5,658,204 | A | 8/1997 | Nappi |
| 5,797,804 | A | 8/1998 | Chen |
| 5,997,410 | A | 12/1999 | Nothdurft |

*Primary Examiner*—Paul T. Sewell
*Assistant Examiner*—Alvin Hunter
(74) *Attorney, Agent, or Firm*—DeLio & Peterson, LLC

(57) ABSTRACT

A practice putting device, adapted for use with a golf putter club having a putter blade, a shaft and a handle, is provided for guiding the blade of the club on a straight line through the putting stroke. The device comprises a clamp means for holding the shaft of the putter club and a carriage having first and second arms pivotally mounted to the clamp means in a horizontal plane for upward and downward arc pivotable movement of the arms. The device is used with an elongated planar board wherein the board is positioned on the putting surface. The shaft of the putter is secured in the clamping means and the carriage (and arms) of the putting device are adjusted so that they are substantially transverse to the plane of the board. When the putter head is moved to strike the ball, the putter blade is moved transverse to the golf ball as the putter head is moved back and forth with the arms of the device in contact with the board. The device can be easily adjusted by the golfer to try different putting positions and strokes.

3 Claims, 4 Drawing Sheets

PUTTING STROKE TRAINING AID

BACKGROUND OF THE INVENTION

1. Field of the Invention

The present invention relates generally to golf equipment and, more particularly, to a practice putting device adapted for use with a golf putter club to enable the user to develop a proper putting stroke which keeps the blade of the putter club perpendicular to the path of the stroke through the putting stroke so that the struck golf ball travels on its intended path toward the golf cup.

2. Description of Related Art

Golf is an extremely difficult game to play because it requires hand, eye, and body coordination as well as the mental capabilities to swing a golf club to hit a golf ball accurately toward an intended target.

While seemingly simple, one of the most difficult shots in the game of golf is that of putting. The object of the putting stroke is to direct the ball by striking the ball with the blade of the putter club so that the ball travels in the intended line toward the golf cup. This requires that the blade of the putter be precisely transverse to the intended path of the ball and that the blade of the putter be maintained in this proper transverse orientation throughout the putting stroke.

A number of patents have been granted directed to golf putting training devices to help the golfer improve the putting stroke. U.S. Pat. No. 2,776,836 to Zadina shows a putting guide consisting of a carriage 14 which holds the putter shaft and two support arms 78 in a Y-shape to rotatably secure spherical rollers 82 at the end of the support arms. A flat plate is positioned and the wheels of the carriage placed against the plate. When the putter 16 is moved longitudinally on the plate surface, it engages the golf ball and the putter is moved by the wheels in a straight line along the surface of the plate.

U.S. Pat. No. 5,026,066 to Kane shows a putting guide using a flat surface which is secured between a golfer's legs. The guide clamp 32 secures a putter shaft 42 and carries rollers at the periphery of the Y-shaped clamp. In use, the putter shaft is secured by the guide clamp, the roller is positioned against the flat surface 12 and the rollers 36 are moved along the face of the flat surface when the putter is moved providing a straight stroke.

U.S. Pat. No. 2,723,858 Chizewski shows a putter shaft 16 clamped to a V-shaped guide wheel 17. The wheel when placed on rod 13 keeps the club head straight during the putting stroke. A similar device is shown in U.S. Pat. No. 3,132,865 to Parker. U.S. Pat. No. 3,471,155 to Donaldson shows a golf training device using a carriage 11 having wheels 35. The device moves along in a base plate 16 which keeps the putter straight during the putting stroke. U.S. Pat. No. 4,700,949 to Nottoli shows the use of a trolley 11 which rolls on wheels engaged with a rail 10. The putter 34 is attached to the trolley and moves straight along the rail during the putting stroke.

There is still a need however for practice putting devices which are adapted for use with a golf putter club for guiding the blade of the club on a straight line throughout the putting stroke.

Bearing in mind the problems and deficiencies of the prior art, it is therefore an object of the present invention to provide a practice putting device adapted for use with a golf putter club having a putter blade, a shaft and a handle, for guiding the blade of the club on a straight line throughout the putting stroke.

Still other objects and advantages of the invention will in part be obvious and will in part be apparent from the specification.

SUMMARY OF THE INVENTION

The above and other objects and advantages, which will be apparent to those skilled in art, are achieved in the present invention which is directed to, in a first aspect, a practice putting training device adapted for use with a golf putter club having a putter blade, a shaft and a handle or grip, for guiding the club on a straight line throughout the putting stroke comprising:

clamp means for holding the shaft of a putter club;

a carriage having first and second arms which carriage is horizontally pivotally mounted to the clamp so that the arms move in an upward and downward arc; and an elongated planar board;

wherein the elongated planar surface of the board is vertically disposed on a putting surface, the golf putter club shaft is secured in the clamping means and the vertical position of the arms adjusted so that the ends of the arms are substantially transverse to the surface of the board;

whereby the putter blade is maintained transverse to a desired path a golf ball is to travel on the putting surface as the putter blade is moved back and forth with the ends of the arms in contact with the surface of the board during the putting stroke and as the blade strikes the ball.

In another aspect of the invention a practice putting training device adapted for use with a golf putter club having a putter blade, shaft and a handle, for guiding the club on a straight line throughout the putting stroke is provided comprising:

a first clamping means comprising an elongated body having an upper concave portion and an upper convex raised portion with a longitudinal pivot pin opening in the raised portion, the lower surface of the clamping means having an indent opening and bores on each side of the indent for securing a second clamping means thereto;

a second clamping means comprising a flat plate having two through openings therein in registration with the bores, which second clamping means is secured to the first clamping means by fasteners extending through the openings in the flat plate into the bores in the first clamping means;

a U-shaped guide means comprising an elongate base having a concave portion and a raised convex portion with a longitudinal pivot pin opening in the raised portion and a first arm and a second arm extending outward from the base; and an elongated planar board;

wherein the convex raised portion of the first clamping means mates with the concave portion of the guide means and the concave portion of the first clamping means mates with the raised convex portion of the guide means whereby the first and second arms are moveable up and down in an arc relative to the first clamping means by a pivot pin inserted in the pivot pin openings of the first clamping means and guide means and the shaft of the putter is secured in the indent by securing the second clamping means to the first clamping means;

whereby the putter blade is maintained transverse to a desired path a golf ball is to travel on a putting surface as the putter blade is moved back and forth with the ends of the arms in contact with the surface of the board during the putting stroke and as the blade strikes the ball.

In another aspect of the invention the practice putting training device is made of plastic or metal which has a low coefficient of friction vis-à-vis the elongated planar board along which the device is moved during the putting stroke.

In another aspect of the invention the ends of the arms are rounded to further decrease the friction between the arms of the device and the planar board enhancing the use of the device during the practice putting stroke.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–7B of the drawings in which like numerals refer to like features of the invention.

Figure 1:
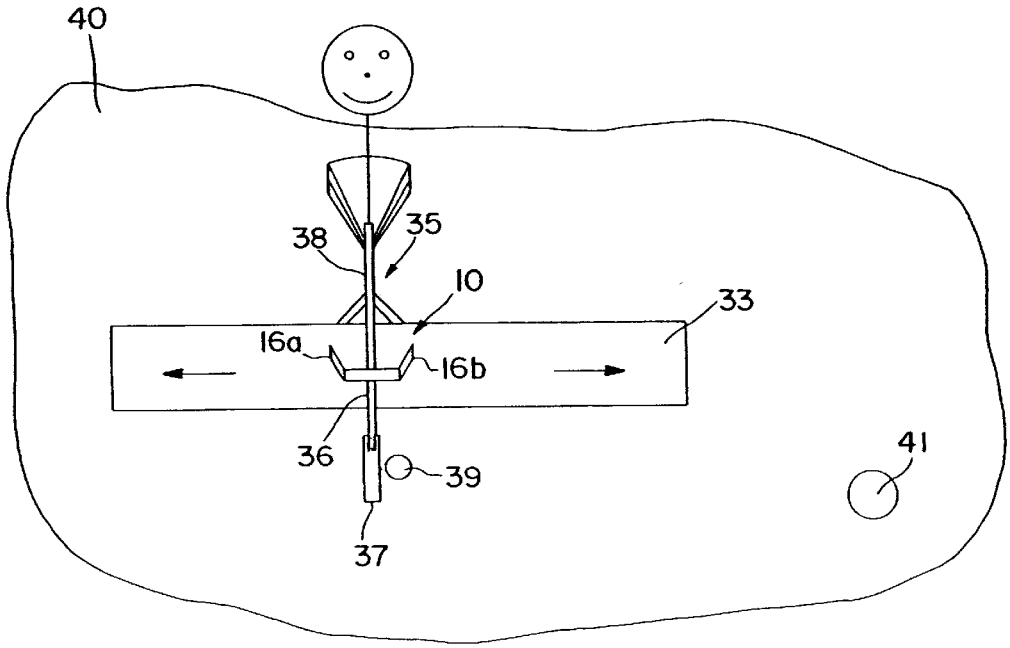
FIG. 1 is a perspective view of a golfer using the practice putting device of the invention.

Referring first to FIG. 1, a golfer using the practice putting device of the invention is shown putting a golf ball on a putting green. The putting green 40 has a cup 41 and it is the object of the putting stroke to hit the ball 39 into the cup 41.

An elongated substantially planar board 33 is positioned on the green 40 so that the planar surface of the board is substantially transverse to the green (typically about 9°). The board may be at any angle to the green and the putting device may be adjusted to accommodate the angled planar surface as will be described hereinbelow. For convenience however, the planar surface of the board will be described as substantially transverse to the green. The board has supports (not shown) to keep the board upright.

The golf shaft 36 of the club 35 is secured in the putting device shown generally as 10. During practice, the golfer moves the arms 16*a* and 16*b* of the putting device 10 along the surface of planar board 33 in a backward and forward motion as shown by the arrows so that the golf club blade 37 is perpendicular to the ball 39 and the ball is directed in a straight line toward cup 41.

Figure 2:
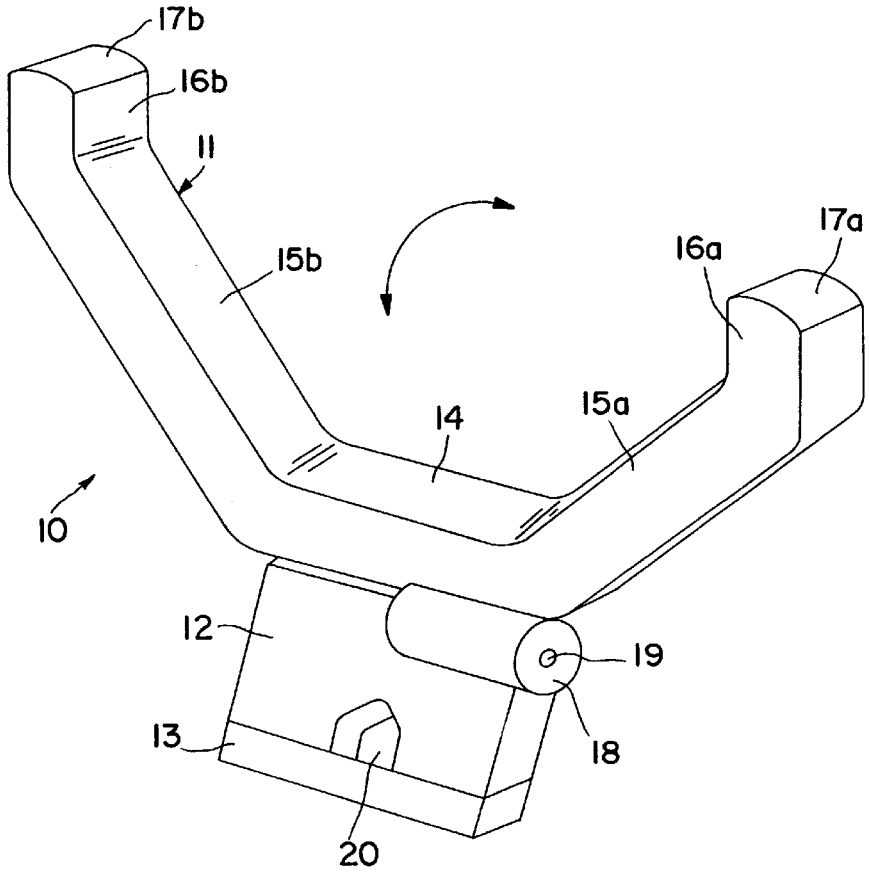
FIG. 2 is a perspective view of a preferred device of the invention used to hold the shaft of the golf putter club.

Referring now to FIG. 2, a preferred practice putting device of the invention is shown generally as 10. The device has a carriage section shown generally as 11, a first clamping section shown generally as 12 and a second clamping section shown generally as 13. The carriage 11 has an elongated body 14 and a right arm 15*a* and a left arm 15*b* extending angularly from each end of the carriage body. A transverse right arm extension 16*a* and transverse left arm extension 16*b* extends from the end of the arms and terminates in rounded surfaces 17*a* and 17*b*. The carriage has a swivel flange 18 with an opening 19 to support a pivot pin. The first clamping portion 12 is pivotally connected to carriage 11 and has an indent 20 therein to secure the shaft of a golf club. The second clamping means 13 is shown secured to first clamping means 12 closing indent 20 and would hold the golf shaft securely in indent 20.

As can be seen from the figure, the carriage portion 11 can be moved about the pivot pin 19 in an up and down arc motion (shown by the arrows) relative to the first and second clamping means 12 and 13 and it is an important feature of the invention that when the golf club shaft is secured in indent 20, that the arms of the carriage can be easily positioned substantially transverse to the surface of the planar board 33. The device enables the golfer to use the practice putting device in a number of ways so that the golfer can practice a variety of putting strokes and develop a smooth and reproducible putting stroke resulting from the practice of hitting golf balls using the device.

Figure 3:
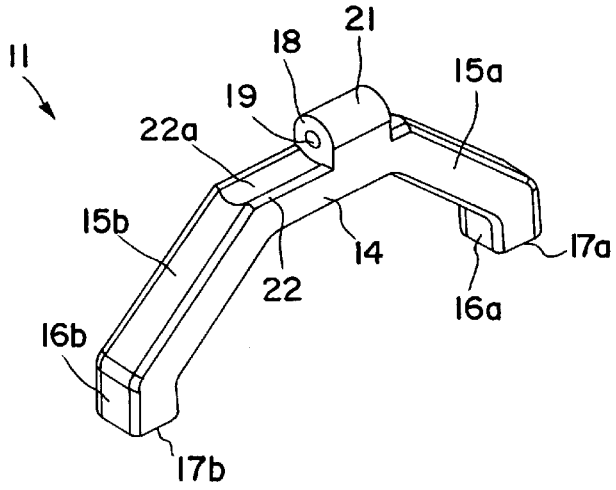
FIG. 3 is a perspective view of the arms containing guide means of the preferred practice putting device.

Referring now to FIG. 3, a perspective view of the carriage 11 is shown. Carriage elongated body 14 is shown having an elongated portion 22 having a concave upper surface 22*a* and a raised elongated portion 18 having a convex surface 21. The raised portion 18 has a pivot pin opening 19 extending into and preferably through the raised portion. Right arm 15*a* and left arm 15*b* extend angularly from the ends of the carriage body 14 and terminate in transverse right extension 16*a* and left extension 16*b*. The ends of the extension are rounded 17*a* and 17*b* to facilitate movement of the device along the planar surface of the board.

Figure 4:
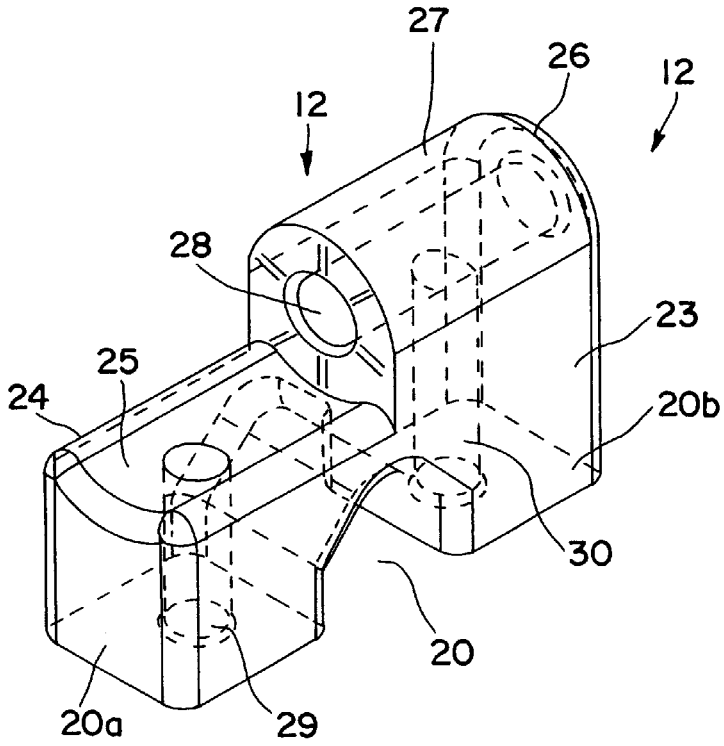
FIG. 4 is a perspective view of a clamping means used in conjunction with the guide means member of FIG. 3.

Referring now to FIG. 4, the first clamping means 12 is shown having an elongated body with a first elongated portion 24 having a concave surface 25. The other elongated portion of the first clamping means body is a raised portion 26 having a convex surface 27. A through hole 28 extends through the raised portion 26. A pivot pin will be accommodated in opening 28 as discussed hereinbelow. The lower surface of first clamping means 12 has an indent 20 and flat portions 20*a* and 20*b* on each side of the indent. Bore 29 is provided in portion 20*a* and bore 30 in portion 20*b*.

Figure 5:
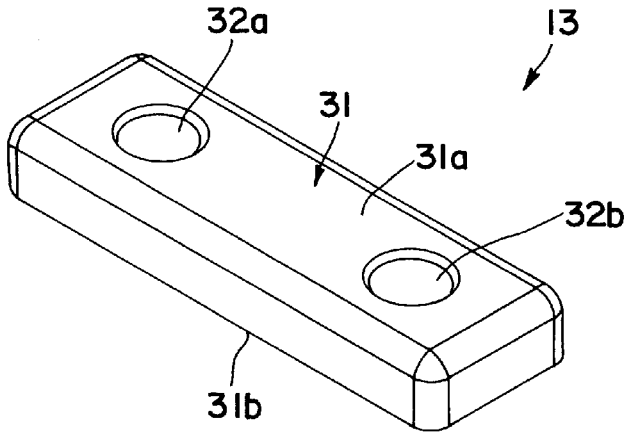
FIG. 5 is a perspective view of a second clamping means used in conjunction with the clamping means of FIG. 4 to secure the putter shaft in the practice putting device.

Referring now to FIG. 5, a rectangular second clamp support 13 is shown. The clamp support 13 comprises a body portion 31 with an upper surface 31*a* and lower surface 31*b* and having through openings 32*a* and 32*b*.

The carriage 11 and first clamp 12 are mated together and secured with a pivot pin extending through the opening 19 in the carriage and opening 28 in clamp 12. Lower surface 31*b* of the second clamp support 13 would be placed against the bottom surfaces 20*a* and 20*b* of clamp 12 and secured to clamp 12 by suitable fasteners such as threaded bolts through openings 32*a* and 32*b* and bores 29 and 30. A golf club shaft would be inserted in indent 20 and then the second clamping means 13 secured to first clamping means 12 to hold the shaft in a fixed position so that the blade of the putter is transverse to the plane formed by the ends of the carriage arms.

The practice putting device of the invention may be made of metal such as aluminum, zinc die cast, etc., or a plastic material. The material preferably has a low coefficient of friction vis-a-vis the planar board. The planar board may also be made of a suitable plastic, wood, fiberboard, etc. and may be coated to provide a low resistance surface, i.e., a plastic film. Suitable plastics include Lexan, styrene and Delrin. Typically, the carriage 11 will be about 4¾ inch long from the end of the left arm to the end of the right arm and have a depth from the end of the arm to the lower surface 31*b* of the second clamp support of about 4–5 inches. It will be appreciated by those skilled in the art that these dimensions can vary widely depending on manufacturing and other considerations. The thickness of the device is typically about ½ inch.

Referring to FIGS. 6A–7B, use of the device by a golfer may be demonstrated. Firstly, it will be appreciated by golfers and others skilled in the art of golfing that although there are certain basic rules of putting, the putting stroke is highly individual and almost every golfer has their own "secret" to putting the ball. Some golfers use an open stance, some a closed stance and some a square stance and some use variations thereof. The distance between the feet will also vary. Some golfers use a long shafted putter and some use a short shafted putter. The angle of the putter shaft to the putter blade also varies. The goal, of course, is to hit the golf ball squarely in a straight line toward the cup and the device of the invention allows the golfer to easily vary a number of the above putting stroke variables to arrive at the perfect stroke for that golfer.

Figure 6A:
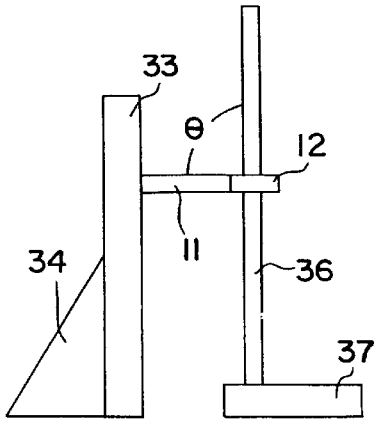
FIGS. 6A and 6B show adjustment of the putting device during practice when used with a putter having a vertical shaft.
Figure 6B:
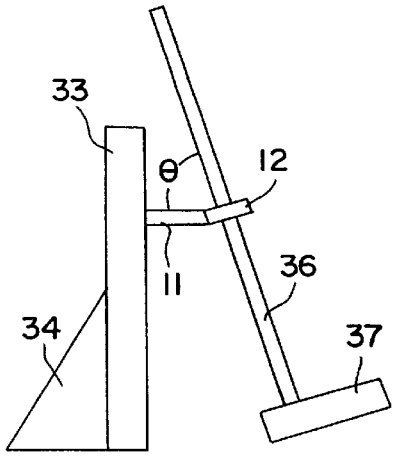

Referring to FIG. 6A, the putter shaft 36 is transverse to the putter blade 37. When the clamping means 12 is secured to the shaft, the carriage 11 is also shown transverse to the clamping means 12 and putter shaft 36. The carriage 11 is likewise transverse to the surface of board 33. The board is supported by support 34 and is typically 18 inches long by 5½ inches high and ½ inch thick. Angle θ is about 90°. In practice however, the golfer may want to try tipping up the end of blade 37 as shown in FIG. 6B so that the tip is off the putting surface. The golfer would adjust the device by simply rotating the carriage 11 about the clamping means 12 decreasing the angle θ. The angle θ is about 85°. In both FIG. 6A and FIG. 6B the carriage 11 is transverse to the surface of board 33.

Figure 7A:
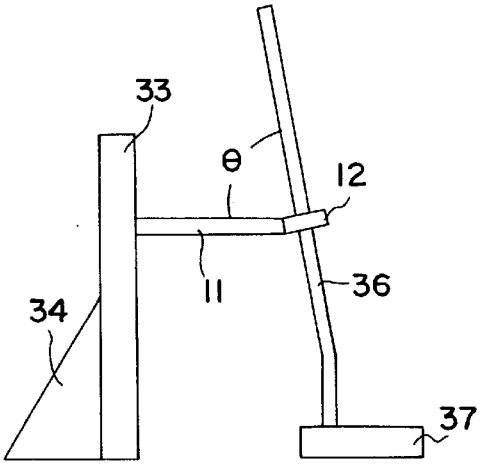
FIGS. 7A and 7B show adjustment of the putting device during practice when used with a putter having a vertically angled shaft.
Figure 7B:
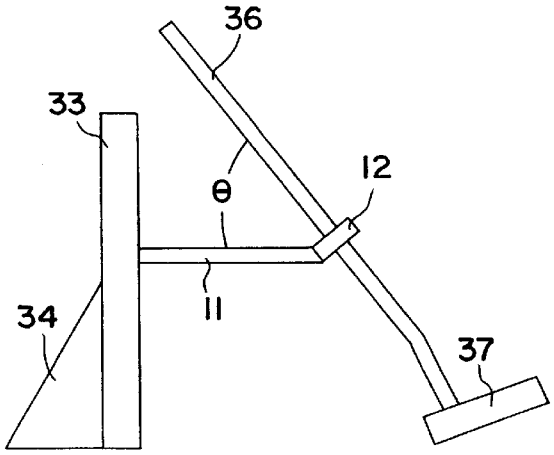

Referring now to FIGS. 7A and 7B, a putter is shown having an angled shaft 36 relative to the blade 37. Accordingly, angle θ is less than 90°, but carriage 11 is still transverse to the surface of planar board 33. In FIG. 7B, the golfer is trying tipping up of the putter blade as in FIG. 6B. Angle θ is now less than angle θ in FIG. 7A and, the golfer can simply adjust the carriage 11 angle so that the carriage 11 is transverse to board 33.

As those skilled in the art will appreciate, a golfer practicing putting can easily adjust the putting aid to try a number of different putting strokes and enhance the effectiveness of the practice session.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A practice putting training device adapted for use with a golf putter club having a putter blade, shaft and a handle, for guiding the club on a straight line throughout the putting stroke comprising:

a first clamping means comprising an elongated body having an upper concave portion and an upper convex raised portion with a longitudinal pivot pin opening in the raised portion, the lower surface of the clamping means having an indent opening and bores on each side of the indent for securing a second clamping means thereto;

a second clamping means comprising a flat plate having two through openings therein in registration with the bores, which second clamping means is secured to the first clamping means by fasteners extending through the openings in the flat plate into the bores in the first clamping means;

a U-shaped guide means comprising an elongate base having a concave portion and a raised convex portion with a longitudinal pivot pin opening in the raised portion and a first arm and a second arm extending outward from the base; and an elongated planar board;

wherein the convex raised portion of the first clamping means mates with the concave portion of the guide means and the concave portion of the first clamping means mates with the raised convex portion of the guide means whereby the first and second arms are moveable up and down in an arc relative to the first clamping means by a pivot pin inserted in the pivot pin openings of the first clamping means and guide means and the shaft of the putter is secured in the indent by securing the second clamping means to the first clamping means;

whereby the putter blade is maintained transverse to a desired path a golf ball is to travel on a putting surface as the putter blade is moved back and forth with the ends of the arms in contact with the surface of the board during the putting stroke and as the blade strikes the ball.

2. The practice putting training device of claim 1 wherein the elongated board is made of fiberboard coated with plastic.

3. The practice putting training device of claim 2 wherein the ends of the arms are rounded.

* * * * *